US011060250B2

(12) United States Patent
Moore et al.

(10) Patent No.: US 11,060,250 B2
(45) **Date of Patent: *Jul. 13, 2021**

(54) EXPANSION JOINT SYSTEM AND EXPANSION JOINT

(71) Applicant: Watson Bowman Acme Corporation, Amherst, NY (US)

(72) Inventors: Gary Moore, Orchard Park, NY (US); Adam Smith, Buffalo, NY (US); Paul Pumm, Tonawanda, NY (US)

(73) Assignee: Watson Bowman Acme Corporation, Amherst, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/566,770

(22) Filed: Sep. 10, 2019

(65) Prior Publication Data

US 2020/0002906 A1 Jan. 2, 2020

Related U.S. Application Data

(63) Continuation-in-part of application No. 16/114,875, filed on Aug. 28, 2018, now Pat. No. 10,407,900.

(60) Provisional application No. 62/560,002, filed on Sep. 18, 2017.

(51) Int. Cl.
*E01D 19/06* (2006.01)
*E01C 11/10* (2006.01)

(52) U.S. Cl.
CPC ..... *E01D 19/065* (2013.01); *E01C 11/106* (2013.01); *E01D 19/06* (2013.01)

(58) Field of Classification Search
CPC ..... E01D 19/06; E01D 19/065; E01C 11/106
USPC ..... 14/73.5; 52/393, 396.04, 402; 404/50, 404/51, 68
See application file for complete search history.

(56) References Cited

U.S. PATENT DOCUMENTS

| | | | | |
|---|---|---|---|---|
| 3,864,886 | A | 2/1975 | Thom | |
| 4,362,429 | A | 12/1982 | Puccio | |
| 4,637,085 | A | 1/1987 | Hartkorn | |
| 5,082,394 | A | 1/1992 | George | |
| 5,259,162 | A | 11/1993 | Nicholas | |
| 6,532,708 | B1 * | 3/2003 | Baerveldt | E01D 19/06 404/47 |

(Continued)

OTHER PUBLICATIONS

Office Action in U.S. Appl. No. 16/114,875 dated Dec. 6, 2018.

*Primary Examiner* — Gary S Hartmann
(74) *Attorney, Agent, or Firm* — Curatolo Sidoti Co., LPA; Salvatore A. Sidoti

(57) ABSTRACT

An expansion joint sealing system for bridging and sealing a gap located between two spaced-apart structural deck members. The expansion joint sealing system includes an elastomeric seal member and a substantially rigid plate member. The elastomeric seal member is fixedly attached to an underlying structural deck member and is able to expand and contract in the longitudinal direction in relation to the traffic direction across the expansion joint. The rigid plate is not fastened to the elastomeric seal member with mechanical fasteners or other fastening means, but is slidingly engaged with the elastomeric seal member through an elongated guide member. As the rigid plate member is not fastened to the elastomeric seal member, it is able to move along a guide member in a direction that is transverse to the direction of traffic across the expansion joint.

22 Claims, 9 Drawing Sheets

(56) References Cited

U.S. PATENT DOCUMENTS

| | | | | |
|---|---|---|---|---|
| 7,389,555 | B2 * | 6/2008 | Xu | E01D 19/06 14/73.1 |
| 7,409,802 | B2 | 8/2008 | Fiedler | |
| 7,832,169 | B2 | 11/2010 | Engstrom | |
| 7,908,819 | B2 | 3/2011 | Neuhofer, Jr. | |
| 8,099,921 | B2 | 1/2012 | Muehlebach | |
| 8,499,394 | B1 | 8/2013 | Haydu | |
| 9,234,321 | B2 | 1/2016 | Haydu | |
| 10,184,243 | B2 * | 1/2019 | Hamilton | E04B 1/6803 |
| 10,407,900 | B2 * | 9/2019 | Moore | E01D 19/065 |
| 10,563,360 | B2 * | 2/2020 | Bang | E01D 19/041 |
| 2008/0148499 | A1 | 6/2008 | Bradford | |
| 2018/0209104 | A1 | 7/2018 | Bang et al. | |

* cited by examiner

EXPANSION JOINT SYSTEM AND EXPANSION JOINT

CROSS REFERENCE TO RELATED APPLICATIONS

This application is a continuation-in-part of U.S. Ser. No. 16/114,875 filed Aug. 28, 2018, which claims the benefit of the filing date under 35 U.S.C. § 119(e) from U.S. Provisional Application For Patent Ser. No. 62/560,002, filed Sep. 18, 2017, both of which are hereby incorporated by reference in their entireties.

TECHNICAL FIELD

The present disclosure relates to an expansion joint system for covering a gap located between sections of a deck structure, such as, for example, roadways, bridges and parking decks. The present disclosure also relates an expansion joint with a gap located between deck sections and having the expansion joint system secured the deck sections to bridge the gap, and a method for installing the expansion joint system.

BACKGROUND

An opening or gap is purposely provided between adjacent structural members for accommodating dimensional changes within the gap occurring as expansion and contraction due to temperature changes, and/or seismic cycling and vibration. An expansion joint system is conventionally installed in the gap to provide a bridge across the gap and to accommodate the movements in the vicinity of the gap.

Bridge and roadway constructions are especially subject to relative movement in response to the occurrence of thermal changes, seismic events, and vehicle loads. This raises particular problems, because the movements occurring during such events are not predictable either with respect to the magnitude of the movements or with respect to the velocity of the movements. In some instances bridges have become unusable for significant periods of time, due to the fact that traffic cannot travel across damaged expansion joints.

Known expansion joint systems utilize a movable rubber seal and a steel cover plate to bridge an expansion joint gap. The steel cover plate is fixedly bolted to the rubber seal member. Because the cover plate and rubber seal are bolted together, movement of the expansion joint system in the traverse direction (the direction perpendicular to the direction of traffic across the expansion joint) is severely constrained. Limited transverse movement may only be accomplished through pushing and shearing of the rubber seals. What is needed in the industry is an expansion joint system that is able to accommodate larger movements in the transverse direction.

SUMMARY

Provided is an expansion joint system comprising an elastomeric seal member attached to one of said spaced structural deck members, said elastomeric seal member having a recess formed along at least a portion of a side of said seal member, wherein said elastomeric seal member can expand and contract in the longitudinal direction, an elongated guide positioned within said recess of said elastomeric seal member and extending along at least a portion of said recess, and a rigid plate member having opposite facing top and bottom surfaces and a dimension sufficient to bridge said gap located between said spaced structural deck members, said rigid plate member having a groove formed in said bottom surface, wherein said groove engages said elongated guide and wherein said rigid plate member can slide in the transverse direction.

Further provided is an expansion joint comprising spaced structural deck members with a gap located between said structural deck members, an elastomeric seal member attached to one of said spaced structural deck members, said elastomeric seal member having a recess formed along at least a portion of a side of said seal member, wherein said elastomeric seal member can expand and contract in the longitudinal direction, an elongated guide positioned within said recess of said elastomeric seal member and extending along at least a portion of said recess, and a rigid plate member having opposite facing top and bottom surfaces and a dimension sufficient to bridge said gap located between said spaced structural deck members, said rigid plate member having a groove formed in said bottom surface, wherein said groove engages said elongated guide and wherein said rigid plate member can slide in the transverse direction.

DETAILED DESCRIPTION

Figure 1:
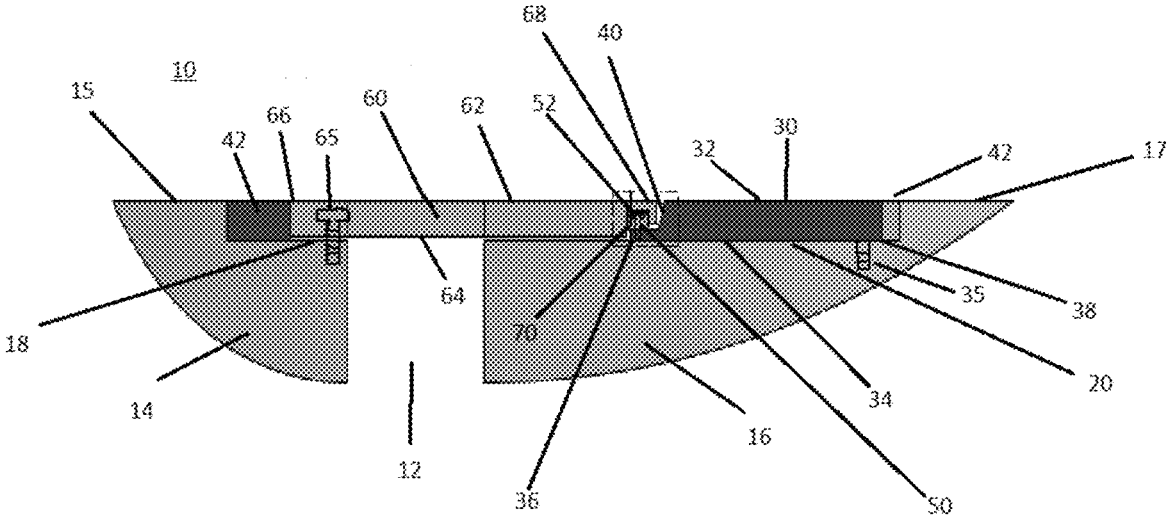
FIG. 1 is a cross-section view of an illustrative embodiment of the expansion joint sealing system installed across an expansion joint having a gap located between structural members.

Disclosed is an expansion joint sealing system for covering a gap located between two spaced-apart structural deck members. The expansion joint sealing system comprises an elastomeric seal member and a substantially rigid plate member. The elastomeric seal member is attached to an underlying structural deck member and is able to expand and contract in the longitudinal direction in relation to the flow of traffic (human or vehicular) across the expansion joint. The rigid plate member is slidingly engaged with the elastomeric seal member and is able to move in the transverse direction along a guide surface. The rigid plate is not fixedly attached to the elastomeric seal member with mechanical fasteners or any other fastening means. As the rigid plate member is not mechanically attached to the elastomeric seal member, the rigid plate and the rubber seal member are capable of moving independently of one another in the transverse direction. The elastomeric seal member may expand and contract in the longitudinal direction while the rigid plate member moves independently in the transverse direction.

As used in the present Specification, the term "longitudinal direction" means the direction of traffic, human or vehicular, across the expansion joint system.

As used in the present Specification, the term "transverse direction" means a direction that is substantially perpendicular to the direction of traffic across the expansion joint system, or perpendicular to the longitudinal direction.

The term "elastomeric" refers for a material that possesses rubber-like properties, for example, an elastomeric material will substantially recover its original dimensions after compression and/or elongation. The elastomeric seal member may be molded from a material selected from natural rubber, synthetic rubbers and combinations of natural and synthetic rubbers. The expansion joint seal member may be manufactured from a thermoplastic elastomer. Suitable thermoplastic elastomers include, without limitation, styrene-butadiene rubber, butadiene rubber, butyl rubber, ethylene-propylene rubber, ethylene-propylene-diene rubber, polyisoprene rubber, polychloroprene rubber, ethylene-alkene copolymer rubbers, silicon rubber, nitrile rubber, and blends thereof. According to certain illustrative embodiments, the elastomeric seal member comprises an ethylene-propylene-diene rubber. The molded elastomeric seal member may be provided in a wide variety of cross sections and geometric configurations. According to certain embodiments, the elastomeric seal member comprises a molded elastomeric panel that is capable of expanding and contracting in the longitudinal direction. According to other certain embodiments, the elastomeric seal member comprises a molded elastomeric panel that is capable of expanding and contracting in the longitudinal direction, and is also capable of limited movement in the transverse direction. According to certain embodiments, the elastomeric seal member may be reinforced with one or more rigid elements. The rigid elements may include metal, metal alloy or composite material plates or shapes.

According to certain embodiments, the elastomeric seal members of the expansion joint system comprise opposite facing top and bottom face surfaces. The elastomeric seal members also include opposite marginal sides that extend in the longitudinal direction and opposite marginal sides that extend in the transverse direction. According to certain embodiments, the transversely extending opposite marginal sides and the longitudinally extending opposite marginal sides form a substantially rectangular molded elastomeric sealing panel. The molded elastomeric sealing members are configured to permit them to be positioned in an end-to-end relationship in the transverse direction within the block out of an expansion joint.

A recess is formed in the thickness of the elastomeric seal member to carry a guide member for the rigid bridging plate. The recess is formed along at least a portion of one transversely extending opposite marginal sides of the elastomeric seal member. According to certain embodiments, the recess may comprise an elongated recess that extends along the entire length of one of the transversely extending opposite marginal sides of the elastomeric seal member. The molded elastomeric seal member is able to expand and contract in the longitudinal direction in relation to the direction of traffic across the expansion joint system.

The elastomeric seal member carries a guide member for the rigid bridging plate member of the expansion joint system. According to certain embodiments, the guide member comprises an elongated guide member that is located within the recess formed in the elastomeric seal member. According to certain embodiments, the elongated guide member is positioned within the recess of the seal member and extends along a portion of the length of the transversely extending marginal side of the elastomeric seal member. According to other embodiments, the elongated guide member is located in the recess of the seal member and extends along the entire length of the transversely extending marginal side of the elastomeric seal member. The guide member is fastened to the elastomeric seal member through one or more mechanical fasteners and/or adhesives. According to certain illustrative embodiments, the guide member comprises an elongated guide bar that extends the substantially entirely or entirely along the length of the transversely extending opposite marginal side of the elastomeric seal member. The guide member may also be referred to as a "slide member" or "slide bar" as it provides a path for guided sliding or translation movement of the rigid bridging plate in the transverse direction independent of the movement of the elastomeric sealing panel.

It should be understood that the guide member may be attached to the elastomeric seal member by any suitable connector, connection means, or connection member. For example, and without limitation, the guide member may be attached to the elastomeric seal member by mechanical fasteners, adhesive, bonding agents, or any combination thereof. According to certain illustrative embodiments, the elongated guide member is attached to the molded elastomeric seal member by mechanical fasteners. Without limitation, and only by way of illustration, suitable mechanical fasteners include threaded bolts, nails, rivets, screws, and tacks. According to certain embodiments, the elongated guide member is attached to the elastomeric seal member by elongated threaded bolts that are passed through openings in the guide member and pass into at least a portion of the thickness of the elastomeric seal member.

The rigid plate member of the expansion joint system has opposite facing top and bottom face surfaces and a thickness extending between the top and bottom face surfaces. The rigid plate also has a dimension, such as a width, that is sufficiently large to bridge or otherwise span the gap that is located between the spaced structural deck members. The rigid plate members also include opposite marginal sides that extend in the longitudinal direction and opposite marginal sides that extend in the longitudinal direction. According to certain embodiments, the transversely extending opposite marginal sides and the longitudinally extending opposite marginal sides form a substantially rectangular rigid plate member.

The rigid plate member includes a groove that is formed in the bottom surface of the plate. According to certain embodiments, the groove extends along a portion of the length of the marginal side of the rigid plate member. According to other embodiments, the elongated groove member extends along the entire length of the marginal side of the rigid plate member.

The elongated groove of the rigid plate is configured to accept at least a portion of the elongated guide member to form a sliding engagement between the rigid plate and the elastomeric seal member. The groove may also be referred to as a receptacle, channel, track, slot, or passage in the rigid plate member that includes a suitable cavity or space for accepting at least a portion of the guide member. The sliding engagement of the rigid plate with the elastomeric seal member permits the rigid plate to slide or translate in the transverse direction independent of the elastomeric seal member. The rigid plate member is allowed to slide back-and-forth in the transverse direction along the elongated guide member.

The groove of the rigid bridging plate may further comprise a layer of a low friction sliding surface material. The use of the sliding surface on the surfaces of the groove promotes unimpeded sliding or translation of the rigid plate member in the transverse direction, and reduces or eliminates noise. Without limitation, and only by way of illustration, a suitable material layer for forming a sliding surface on the surfaces of the groove of the rigid plate member comprises a polymeric material layer. The polymeric material suitable for forming a sliding surface on the groove of the rigid plate may comprise any polymeric material having a lower coefficient of friction than the rigid plate. According to certain embodiments, the polymeric material suitable for forming a sliding surface on the groove of the rigid plate may comprise any thermoplastic polymeric material having a lower coefficient of friction than the rigid plate. According to certain embodiments, without limitation, a suitable polymeric material used for the sliding surface layer on the groove surfaces comprises a polyurethane, polytetrafluoroethylene (PTFE), or similar material.

According to certain illustrative embodiments, expansion joint system comprises the elastomeric seal member having a recess formed along at least a portion of a side of the seal member. The elongated guide has a longitudinal axis and is positioned within the recess of the elastomeric seal member and extends along at least a portion of the recess. The rigid plate member has opposite facing top and bottom surfaces and a dimension that is sufficient to bridge a gap that is located between spaced structural deck members. The rigid plate member has an elongated groove that is formed in the bottom surface of the plate and that is configured to engage the elongated guide. The elongated groove may comprise a top border surface and spaced apart side border surfaces. The side border surfaces of the groove are sloped inwardly toward the midline or longitudinal axis of the elongated groove. The elongated guide may comprise a top surface and spaced apart side surfaces. The side surfaces are sloped inwardly toward the midline or longitudinal axis of the elongated guide. The sloped sides of the elongated groove and the sloped side walls of the elongated guide are in sliding contact to permit the rigid plate member to slide in the traverse direction, but to prevent separation of the rigid plate from the elastomeric seal member in the vertical direction.

The rigid plate member of the expansion joint system may comprise a metal plate, a metal alloy plate, or a composite material plate. According to certain embodiments, the rigid plate comprises a metal alloy plate. According to certain embodiments, the metal alloy plate is selected from a rolled steel plate, a stainless steel plate, or a galvanized steel plate. According to alternative embodiments, the rigid plate member comprises a metal plate member. According to other embodiments, the metal plate member comprises an aluminum plate member.

According to further illustrative embodiments, the elastomeric seal members of the expansion joint system comprise opposite top face and bottom face surfaces, and a thickness that extends between the opposite top and bottom faces. The elastomeric seal members also include opposite marginal sides that extend in the longitudinal direction and opposite marginal sides that extend in the transverse direction. According to certain embodiments, the elastomeric seal members include a first set of opposite marginal sides that extend in the longitudinal direction in a substantially parallel manner, and a second pair of opposite marginal sides that extend in the transverse direction in a substantially parallel manner. According to certain embodiments, the transversely extending opposite marginal sides and the longitudinally extending opposite marginal sides form a substantially rectangular molded elastomeric sealing panel. The molded elastomeric sealing members are configured to permit them to be positioned in an end-to-end relationship in the transverse direction within the block out region of an expansion joint.

The elastomeric sealing member may be provided with a wide variety of geometries for engaging a portion of the elongated guide member of the expansion joint system. By way of illustration, but not in limitation, the elastomeric sealing member may be provided with an elongated opening, such as channel, groove, passageway, slot, or track, formed from the bottom face of the elastomeric sealing member that extends upwardly through at least a portion of the thickness of the sealing member. The structure of the elongated opening is configured to accept a portion of the elongated guide member to engage the rigid plate member with the elastomeric sealing member.

According to certain illustrative embodiments, the guide member comprises a base portion having opposite marginal sides. The opposite marginal sides of the base portion extend in a substantially parallel pattern. An elongated plate guide portion extends upwardly from the upper surface of the base portion of the guide member. The elongated plate guide portion extends along one of the opposite marginal sides of the base portion of the guide member. The elongated plate guide portion is configured to be slidingly engaged with the rigid plate member of the expansion joint system. An upstanding flange member extends upwardly from the top surface of the base portion of the guide member, and extends along the length of the marginal side of the base member opposite of the elongated plate guide member. The upstanding flange member is configured to be engaged with the opening formed in the underside of the elastomeric sealing member. The guide member may optionally include one or more additional upstanding (ie, vertically extending) flanges positioned between the elongated guide member that is engaged with the rigid plate and the upstanding flange that is engaged with the opening of the elastomeric sealing member.

According to certain embodiments, the guide member may be a formed as a monolithic piece including the horizontally extending base portion and vertically extending plate guide portion and at least one vertically extending flange member. According to other embodiments, the guide member may be formed by attaching by mechanical means the elongated plate guide member and the vertically extending flange members to the top surface of the horizontally extending base portion of the guide member. The elongated plate guide member and vertically extending flanges may be attached to the upper surface of the base portion of the guide member by welding the separate material pieces together.

The expansion joint sealing system is installed within cavities or recessed sections that are formed in the spaced-apart structural deck members. These cavities or recessed sections are commonly referred to in the expansion joint field as "blockouts." The expansion joint system is installed within the blockouts of the underlying spaced-apart structural deck members so that the top surfaces of the rigid cover plate and the elastomeric seal member of the expansion joint system are substantially flush with the horizontal top surfaces of the spaced-apart structural deck members to provide a smooth transition across the expansion joint gap.

Portions of one or both of the blockout regions may be filled with a suitable header material to further affix the elastomeric seal member and/or rigid cover plate member to the underlying structural deck members, and to provide a smooth transition across the expansion joint gap. Without limitation, the header material may comprise a polymeric or polymer modified aggregate materials. According to certain illustrative embodiments, the header material used in the blockout regions of the expansion joint comprises a polymer modified aggregate material. Without limitation, a suitable polymer modified aggregate material for use as the header material comprises an elastomeric concrete that is commercially available from Watson Bowman Acme Corporation (Amherst, N.Y., USA) under the trade designation WABOCRETE® II. WABOCRETE® II elastomeric concrete is a self-leveling 100% solids material comprising a two-component polyurethane and aggregate. WABOCRETE® II can bond to concrete, steel and aluminum surfaces, and is capable of monolithically bonding expansion joint sealing system elements to the underlying structural deck members. WABOCRETE® II is also capable of absorbing traffic loads and dispersing them substantially evenly into the structural deck members. A primer may be applied to the underlying concrete structural deck member(s) prior to the installation of WABOCRETE® II. A suitable primer material is commercially available from Watson Bowman Acme Corporation under the trade designation WABO® Bonding Agent.

The present disclosure can be further understood when read in conjunction with illustrative drawing FIGS. 1-8. It should be noted that the expansion joint system is not limited to any of the illustrative embodiments shown in the drawing Figures, but rather should be construed in breadth and scope in accordance with the attached claims.

FIG. 1 is a cross section view of the expansion joint system 10. Expansion joint system 10 is configured to be installed within a gap 12 that is located between adjacent, spaced-apart structural deck members 14 and 16. The expansion joint system 10 is engaged with recessed cavities 18, 20 formed in the marginal edges of the structural deck members 14, 16. These recessed cavities 18, 20 are commonly referred to in the expansion joint industry as "blockouts". Expansion joint system 10 includes an elastomeric seal member 30. The elastomeric seal member 30 includes opposite facing top 32 and bottom 34 surfaces. The elastomeric seal member 30 also includes opposite marginal sides 36, 38. An elongated recess 40 is formed along the marginal side 36 that is positioned near the gap 12 between structural deck members 14, 16. The bottom surface 34 of the elastomeric seal member 30 is in adjacent contact with the surface of the blockout 20. The elastomeric seal member 30 is secured to the underlying structural deck member 16 by mechanical fasteners and an adhesive elastomeric concrete 42 that is located between marginal side 38 of the elastomeric seal member 30 and a marginal side edge of structural deck member 16, and between marginal side 66 of the bridge plate 60 and a marginal side of the structural deck member 14. An elongated guide 50, such as an elongated bar, is attached to the elastomeric seal member 30 within the recess 40. As shown in FIG. 1, the elongated guide member 50 is attached within the recess 40 of the elastomeric seal member 30 by a mechanical fastener 52. It should be understood that the guide member 50 may be attached to the elastomeric seal member 30 by a wide variety of mechanical fasteners, such as threaded bolts, nails, rivets, screws, or tacks, or by a suitable construction adhesive or sealant.

Still referring to FIG. 1, expansion joint system 10 also includes a plate member 60. The plate member 60 extends across the gap 12, and has a dimension that is large enough to bridge the gap 12 from one structural deck member 14 to the adjacent structural deck member 16. The plate member 60 has opposite facing top 62 and bottom 64 surfaces, and opposite marginal sides 66, 68. An elongated groove 70 is formed in the bottom surface 64 of the rigid plate member 60 along marginal side 68. The elongated groove 70 extends along the marginal side 68 of the rigid plate member 60. The rigid plate member 60 is in sliding engagement with the elastomeric seal member 30 and is able to move side-to-side in a transverse direction relative to the direction of traffic across the expansion joint system 10. Once the expansion joint system 10 is installed the top surface 32 of the elastomeric seal member 30 and the top surface 62 of the rigid plate member 50 are substantially flush with the top surface 15 of the deck member 14 and the top surface 17 of deck member 16. The elastomeric seal member 30 is able to expand and contract in the longitudinal direction in response to movement and changes in the size of the gap 12 between deck members 14, 16. The rigid plate member 60 pushes and pulls elastomeric seal member 30 longitudinally during changes in the size of the gap 12, and moves back-and-forth in a traverse direction in relation to traffic, and is capable of moving independently of the elastomeric seal member 30.

Figure 2A:
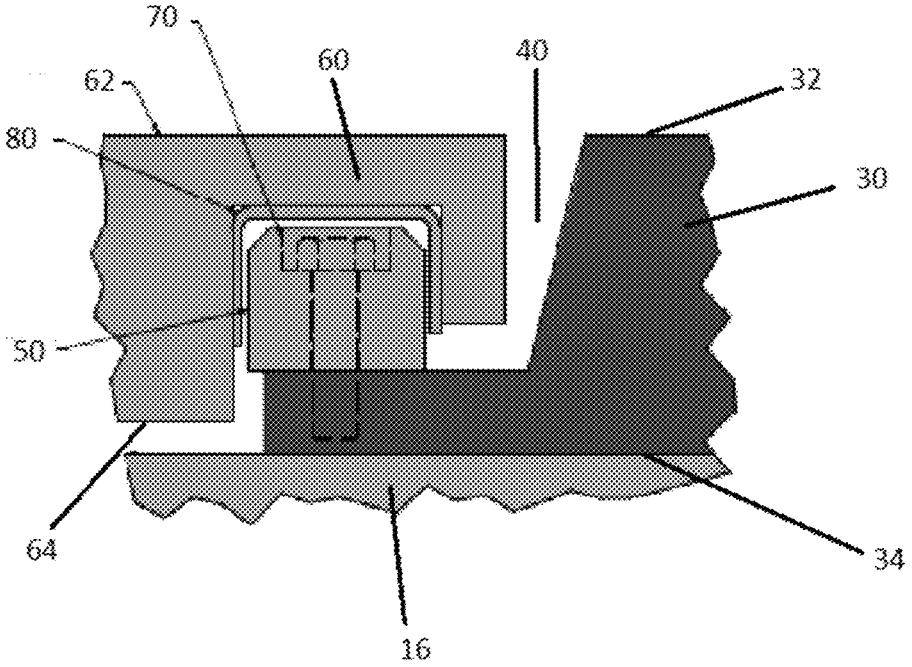
FIG. 2A is a fragmentary view of a portion of FIG. 1 showing an illustrative embodiment of the sliding engagement of the bridging cover plate to the elastomeric seal member.

FIG. 2A is a fragmentary view of the expansion joint system 10 showing the sliding engagement of the rigid plate member 60 to the elastomeric seal member 30. The bottom surface 34 of the elastomeric seal member 30 is shown in adjacent contact with the surface of the block out 20 of the underlying structural deck member 16. The elongated guide member 50 is attached to within the recess 40 of the elastomeric seal member 30 by a mechanical fastener 70 that passes through the elongated guide member 50 and into the thickness of the elastomeric seal member 30. A layer of low friction sliding material 80 is applied to the elongated groove 70 of the rigid plate member 60. The rigid plate member 60 is slidingly engages with the elastomeric seal member 30 by inserting the elongated guide member 50 into the elongated groove 70 of the rigid plate member 60.

Figure 2B:
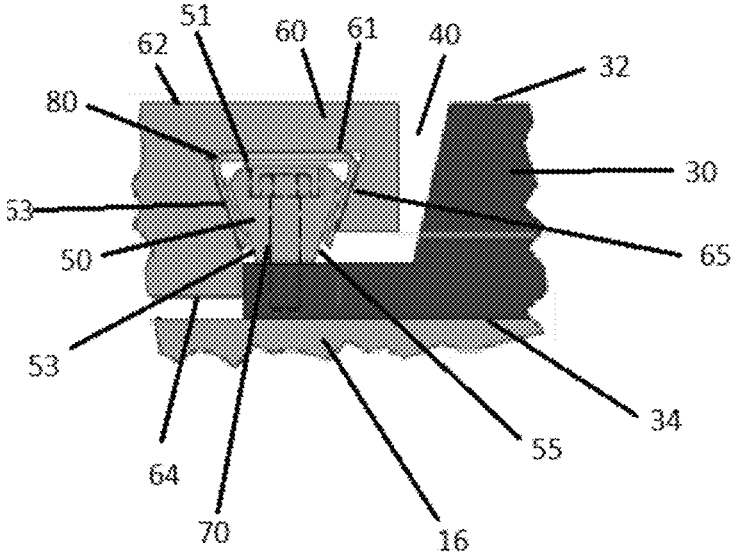
FIG. 2B is a fragmentary view of a portion of FIG. 1 showing another illustrative embodiment of the sliding engagement of the bridging cover plate to the elastomeric seal member.

FIG. 2B is a fragmentary view of another illustrative embodiment of the expansion joint system 10 showing the sliding engagement of the rigid plate member 60 to the elastomeric seal member 30. The bottom surface 34 of the elastomeric seal member 30 is shown in adjacent contact with the surface of the blockout 20 of the underlying structural deck member 16. The elongated guide member 50 is attached to within the recess 40 of the elastomeric seal member 30 by a mechanical fastener 70 that passes through the elongated guide member 50 and into the thickness of the elastomeric seal member 30. A layer of low friction sliding material 80 is applied to the elongated groove 70 of the rigid plate member 60. The rigid plate member 60 is slidingly engaged with the elastomeric seal member 30 by inserting the elongated guide member 50 into the elongated groove 70 of the rigid plate member 60. Further, the vertical faces 53, 55 of elongated guide member 50 and vertical sides 63, 65 of rigid plate 60 are sloped inwardly toward the midline of the elongated guide member 50 to prevent vertical separation of rigid plate 60.

Figure 3A:
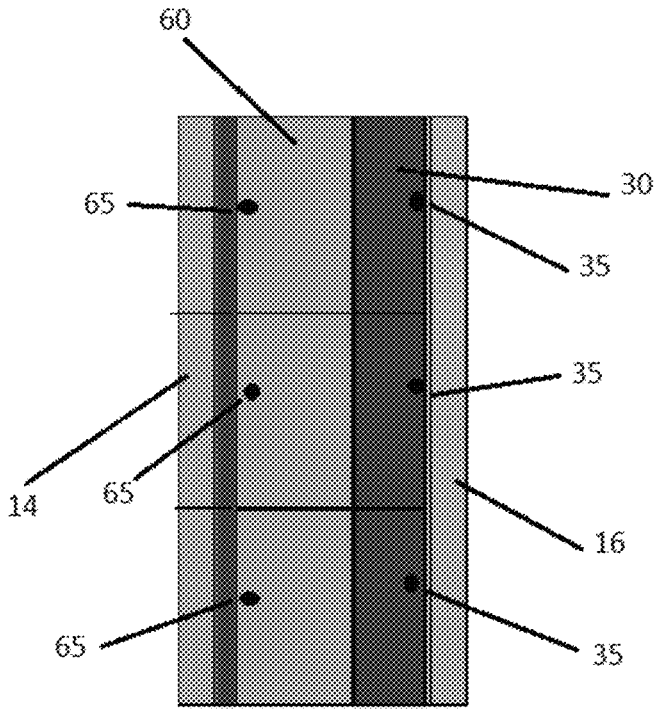
FIG. 3A is a top plan view of the expansion joint system in the neutral position.

FIG. 3A is a top plan view showing the expansion joint system 10. In the illustrative embodiment shown in FIG. 3A, three elastomeric seal members 30 and three rigid plate members 60 are placed in an end-to-end relationship along the expansion joint. The expansion joint system 10 is installed between spaced apart structural deck members 14, 16. Elastomeric seal member 30 is affixed to structural deck member 16 through mechanical fasteners 35 and elastomeric concrete 42 positioned between marginal side 38 of seal member 30 and marginal edge of deck member 16. Rigid plate member 60 is affixed to structural deck member 14 through mechanical fasteners 65 elastomeric concrete 42 positioned between marginal side 66 of plate 60 and marginal edge of deck member 14. Marginal edge 68 is slidingly engaged with marginal side edge 36 of the elastomeric seal member 32.

Figure 3B:
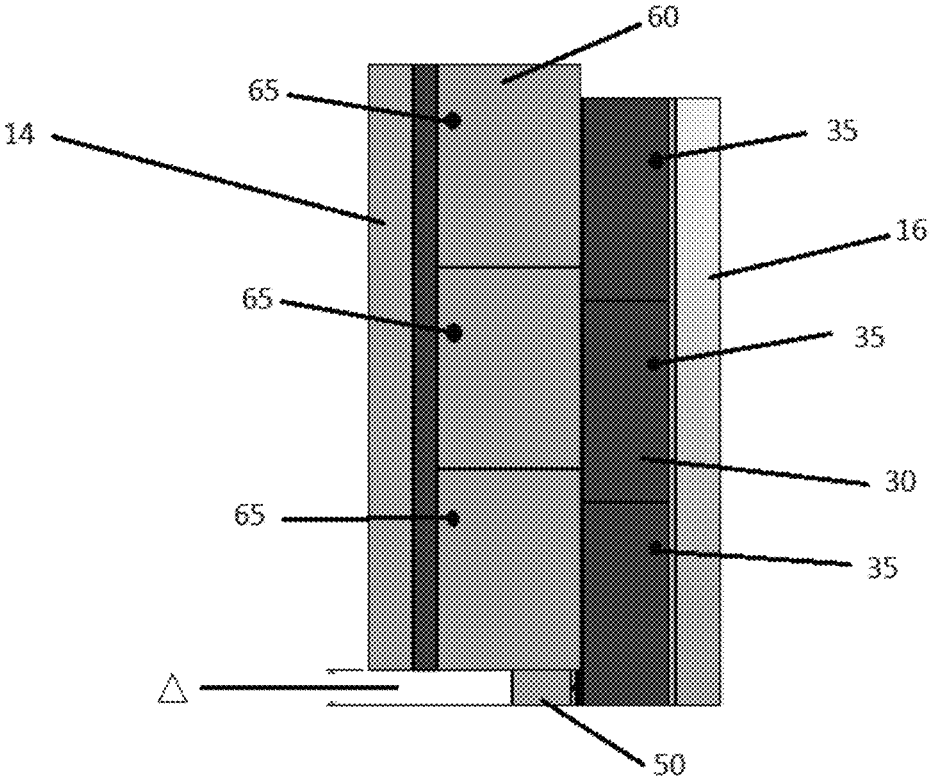
FIG. 3B is a top plan view of the expansion joint system showing the rigid plate member after transverse movement.

FIG. 3B is a top plan view showing the expansion joint system 10 of FIG. 3A in a transversed position. In the illustrative embodiment shown in FIG. 3B, three elastomeric seal members 30 and three rigid plate members 60 are placed in an end-to-end relationship along the expansion joint. The expansion joint system 10 is installed between spaced apart structural deck members 14, 16. Elastomeric seal member 30 is affixed to structural deck member 16 through mechanical fasteners 35 elastomeric concrete 42 positioned between marginal side 38 of seal member 30 and marginal edge of deck member 16. Rigid plate member 60 is affixed to structural deck member 14 through mechanical fasteners 65 elastomeric concrete 42 positioned between marginal side 66 of plate 60 and marginal edge of deck member 14. Marginal edge 68 is slidingly engaged with marginal side edge 36 of the elastomeric seal member 32. The rigid plate members 60 are shown off-set from the elastomeric seal member 32 as a result of the transverse movement of the rigid plates 60.

Figure 4:
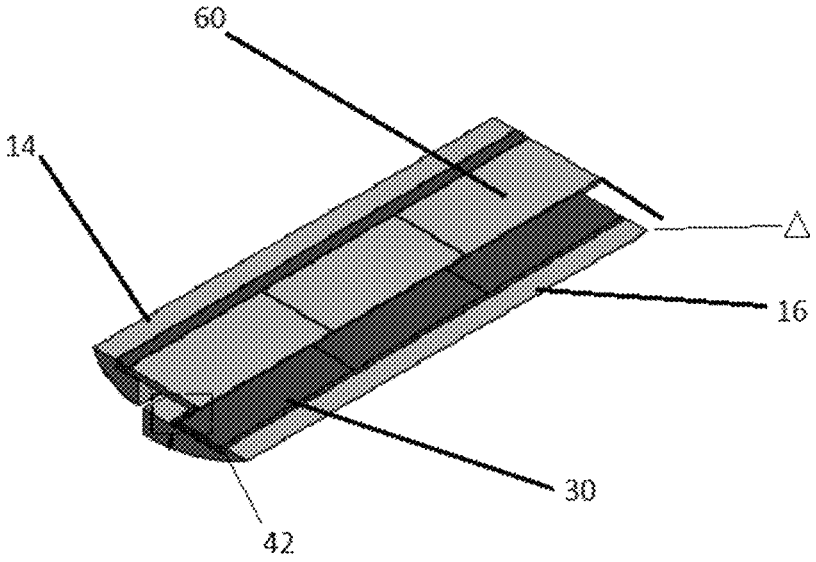
FIG. 4 is a top perspective view of the expansion joint system showing the rigid plate member after transverse movement.

FIG. 4 is a top perspective view showing the expansion joint system 10 of FIGS. 3A/3B in a transversed position. In the illustrative embodiment shown in FIG. 4, three elastomeric seal members 30 and three rigid plate members 60 are placed in an end-to-end relationship along the expansion joint. The expansion joint system 10 is installed between spaced apart structural deck members 14, 16. Elastomeric seal member 30 is affixed to structural deck member 16 through elastomeric concrete 42 positioned between marginal side 38 of seal member 30 and marginal edge of deck member 16. Marginal edge 68 is slidingly engaged with marginal side edge 36 of the elastomeric seal member 32. The rigid plate members 60 are shown off-set from the elastomeric seal member 32 as a result of the transverse movement of the rigid plates 60.

Figure 5:
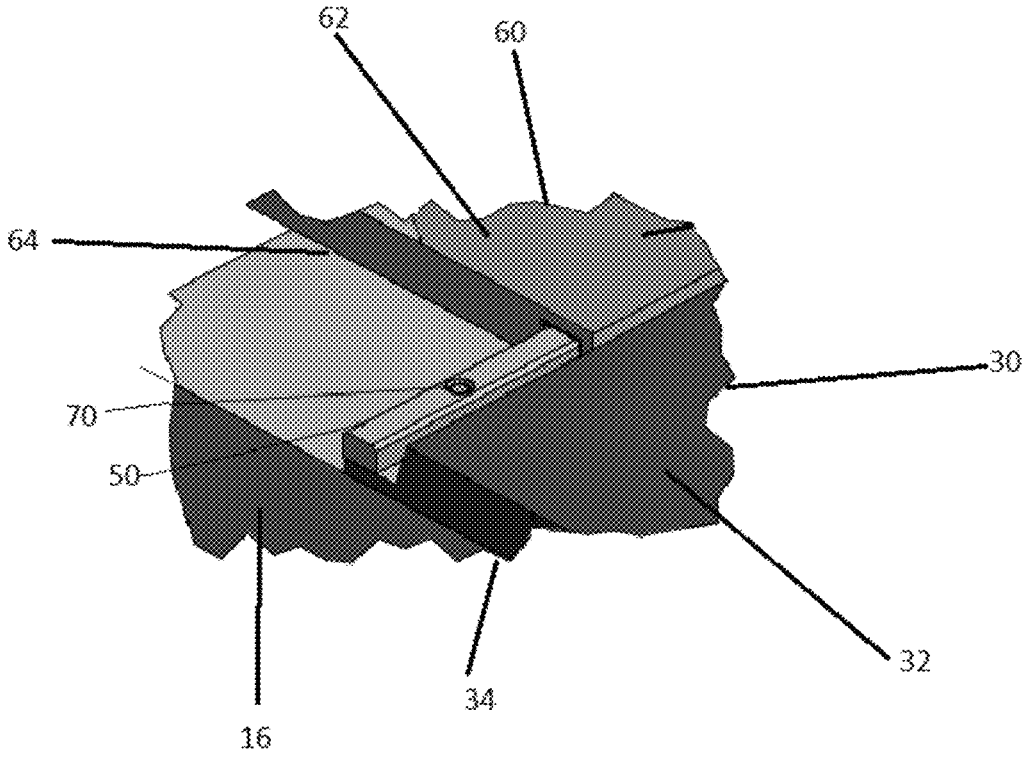
FIG. 5 is a fragmentary view of a portion of FIG. 4 showing the bridging cover plate in the transversed position.

FIG. 5 is a fragmentary view of the expansion joint system 10 of FIG. 4 showing the sliding engagement of the rigid plate member 60 to the elastomeric seal member 30 in greater detail. FIG. 5 shows the elongated guide bar 50 mechanically fastened to the elastomeric seal member 30 with fastener 70. The rigid plate member 60 is slidingly engaged with the underlying elastomeric seal member 30 be the sliding engagement of the guide member 50 with the groove 70 formed in the rigid plate member 60. In the embodiment shown in FIG. 5, the rigid plate 60 has moved transversely along guide member 50 and is off-set from the elastomeric seal member 30.

Figure 6:
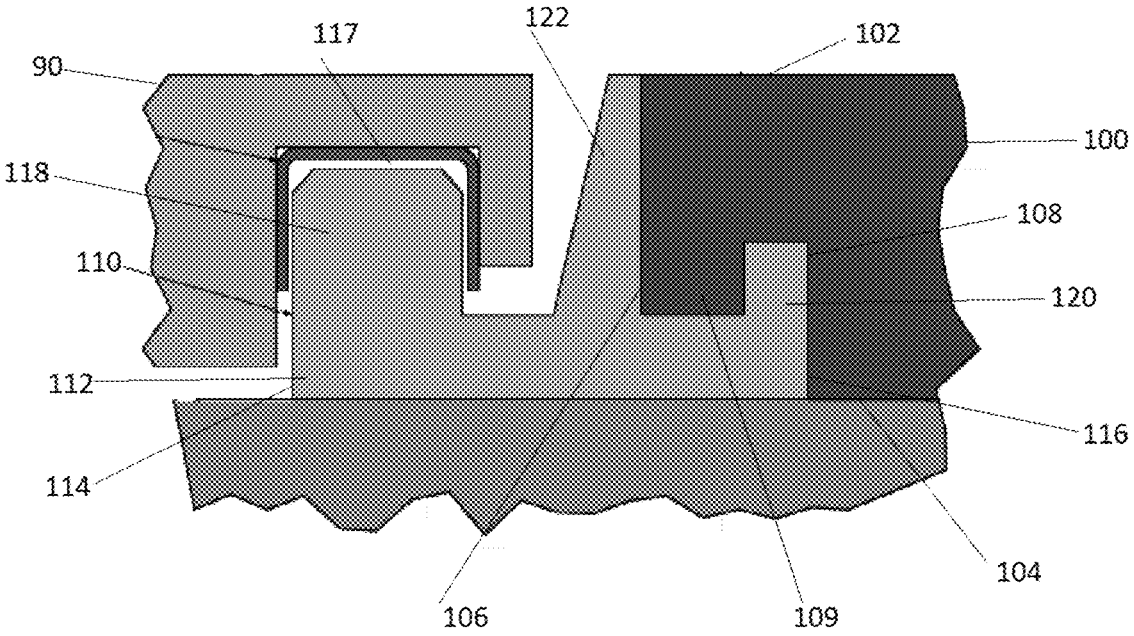
FIG. 6 is a fragmentary view of a portion of an illustrative embodiment of the expansion joint sealing system installed across an expansion joint having a gap located between structural members showing the sliding engagement of the bridging cover plate to the elastomeric seal member.

FIG. 6 is a fragmentary view of the expansion joint system 10 showing the sliding engagement of the rigid plate member 90 to the elastomeric seal member 100 with guide member 110 in greater detail. The rigid plate member 90 is engaged with the elastomeric seal member 100 by the guide member 110. Guide member 110 is a monolithic piece including a horizontally extending base portion 112 having opposite marginal sides 114, 116. An elongated plate guide member 118 extends upwardly from the top surface of the base portion 112 of the guide member 110. The elongated plate guide member 118 extends longitudinally along marginal side 114 of base portion 112. Guide member 110 also includes vertically extending flange portion 120. Vertically extending flange portion 120 also extends longitudinally along marginal side 116 of base portion 112 of guide member 110. Elastomeric seal 100 includes a top surface 102, a bottom surface 104 and a thickness "T" extending between the top 102 and bottom 104 surfaces. Elastomeric seal 100 also includes vertical marginal side 106. Elastomeric seal 100 includes a longitudinal groove 108 formed from the bottom surface 104 of the seal 100 and which extends through a portion of the thickness of the elastomeric seal 100. Flange portion 120 of guide member 110 is inserted into groove 108 of the elastomeric seal to engage rigid plate 90 to the elastomeric seal 100. Second flange member 122 of guide member 110 is positioned between the first flange member 120 and the elongated guide member 118. Second flange member 122 extends vertically from the top surface of the base portion 112 of guide member 110, and is positioned adjacent the marginal side wall 106 of the elastomeric seal 100. Lip portion 109 of elastomeric seal 100 is engaged with the guide member 110 by fitting lip 109 into the space between the first 120 and second 122 vertically extending flange members of the guide member 110. Elongated guide member 118 extends upwardly from the top surface of the base portion 112 of the guide member 110. The rigid plate 90 is slidingly engaged with the elastomeric seal 100 by locating the elongated guide member 118 within the groove 117 formed in the rigid plate member 100.

Figure 7:
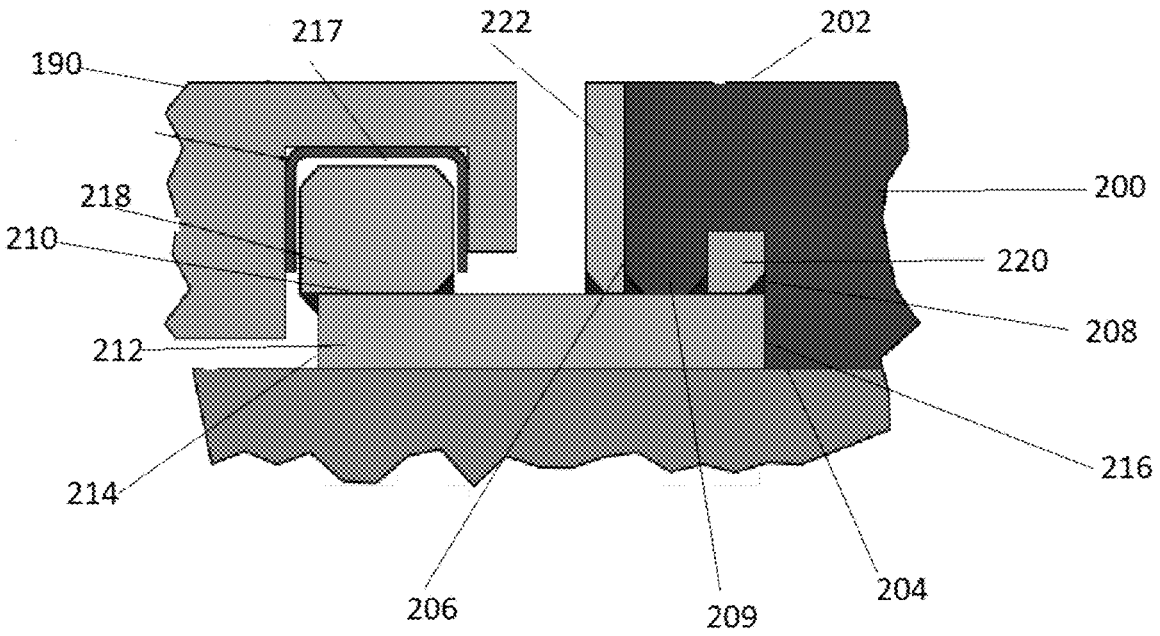
FIG. 7 is a fragmentary view of a portion of an illustrative embodiment of the expansion joint sealing system installed across an expansion joint having a gap located between structural members showing the sliding engagement of the bridging cover plate to the elastomeric seal member.

FIG. 7 is a fragmentary view of the expansion joint system 10 showing the sliding engagement of the rigid plate member 190 to the elastomeric seal member 200 with guide member 210 in greater detail. The rigid plate member 190 is engaged with the elastomeric seal member 200 by the guide member 210. Guide member 210 includes a horizontally extending base portion 212 having opposite marginal sides 214, 216. An elongated plate guide member 218 extends upwardly from the top surface of the base portion 212 of the guide member 210. The elongated plate guide member 218 extends longitudinally along marginal side 214 of base portion 212. Guide member 210 also includes vertically extending flange portion 220. Vertically extending flange portion 220 also extends longitudinally along marginal side 216 of base portion 212 of guide member 210. Elastomeric seal 200 includes a top surface 202, a bottom surface 204 and a thickness "T" extending between the top 202 and bottom 204 surfaces. Elastomeric seal 200 also includes vertical marginal side 206. Elastomeric seal 200 includes a longitudinal groove 208 formed from the bottom surface 204 of the seal 200 and which extends through a portion of the thickness of the elastomeric seal 200. Flange portion 220 of guide member 210 is inserted into groove 208 of the elastomeric seal 200 to engage rigid plate 190 to the elastomeric seal 200. Second flange member 222 of guide member 210 is positioned between the first flange member 220 and the elongated guide member 218. Second flange member 222 extends vertically from the top surface of the base portion 212 of guide member 210, and is positioned adjacent the marginal side wall 206 of the elastomeric seal 200. Lip portion 209 of elastomeric seal 200 is engaged with the guide member 210 by fitting lip 209 into the space between the first 220 and second 222 vertically extending flange members of the guide member 210. Elongated guide member 218 extends upwardly from the top surface of the base portion 212 of the guide member 210. The rigid plate 190 is slidingly engaged with the elastomeric seal 200 by locating the elongated guide member 218 within the groove 217 formed in the rigid plate member 190.

Figure 8:
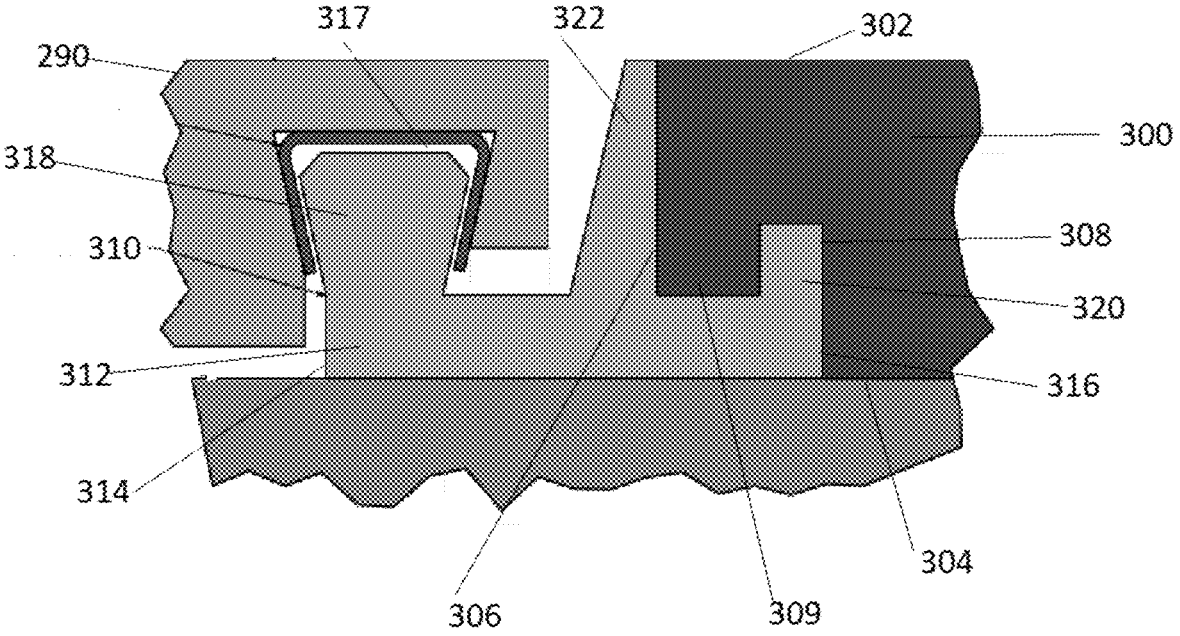
FIG. 8 is a fragmentary view of a portion of an illustrative embodiment of the expansion joint sealing system installed across an expansion joint having a gap located between structural members showing the sliding engagement of the bridging cover plate to the elastomeric seal member.

FIG. 8 is a fragmentary view of the expansion joint system 10 showing the sliding engagement of the rigid plate member 290 to the elastomeric seal member 300 with guide member 310 in greater detail. The rigid plate member 290 is engaged with the elastomeric seal member 300 by the guide member 310. Guide member 310 is a monolithic piece including a horizontally extending base portion 312 having opposite marginal sides 314, 316. An elongated plate guide member 318 extends upwardly from the top surface of the base portion 312 of the guide member 310. The elongated plate guide member 318 extends longitudinally along marginal side 314 of base portion 312. Guide member 310 also includes vertically extending flange portion 320. Vertically extending flange portion 320 also extends longitudinally along marginal side 316 of base portion 312 of guide member 310. Elastomeric seal 300 includes a top surface 302, a bottom surface 304 and a thickness "T" extending between the top 302 and bottom 304 surfaces. Elastomeric seal 300 also includes vertical marginal side 306. Elastomeric seal 300 includes a longitudinal groove 308 formed from the bottom surface 304 of the seal 300 and which extends through a portion of the thickness of the elastomeric seal 300. Flange portion 320 of guide member 310 is inserted into groove 308 of the elastomeric seal to engage rigid plate 290 to the elastomeric seal 300. Second flange member 322 of guide member 310 is positioned between the first flange member 320 and the elongated guide member 318. Second flange member 322 extends vertically from the top surface of the base portion 312 of guide member 310, and is positioned adjacent the marginal side wall 306 of the elastomeric seal 300. Lip portion 309 of elastomeric seal 300 is engaged with the guide member 310 by fitting lip 309 into the space between the first 320 and second 322 vertically extending flange members of the guide member 310. Elongated guide member 318 extends upwardly from the top surface of the base portion 312 of the guide member 310. The rigid plate 290 is slidingly engaged with the elastomeric seal 300 by locating the elongated guide member 318 within the groove 317 formed in the rigid plate member 290.

While the present expansion joint system, expansion joint and method of installing the expansion joint system, have been described above in connection with certain illustrative embodiments, including those embodiments shown in the various drawing figures, it is to be understood that other embodiments may be used or modifications and additions may be made to the described embodiments for performing the same function of the present embodiments without deviating therefrom. Further, all embodiments disclosed are not necessarily in the alternative, as various embodiments of the invention may be combined to provide the desired characteristics. Variations can be made by one having ordinary skill in the art without departing from the spirit and scope of the disclosure. Therefore, the present disclosure should not be limited to any single embodiment, but rather construed in breadth and scope in accordance with the recitation of the attached claims.

The invention claimed is:

1. An expansion joint system comprising:

an elastomeric seal member capable of expanding and contracting in a longitudinal direction;

an elongated guide attached to said elastomeric seal member and having a longitudinal axis; and a rigid plate member having opposite facing top and bottom surfaces and a dimension sufficient to bridge a gap located between spaced structural deck members, said rigid plate member having an elongated groove formed in said bottom surface, wherein said groove of said rigid plate member slidingly engages said elongated guide, wherein said rigid plate member and said elastomeric seal member are not fixedly attached together, wherein said elastomeric seal member can expand and contract in the longitudinal direction, and wherein said rigid plate member can slide in a transverse direction along the elongated guide independently of the elastomeric seal member.

2. The expansion joint system of claim 1, wherein said elastomeric seal member has a recess formed along at least a portion of a side of said seal member, and wherein said elongated guide is positioned within said recess of said elastomeric seal member and extends along at least a portion of said recess.

3. The expansion joint system of claim 2, wherein (i) said elongated groove comprises a top border surface and spaced apart side border surfaces, wherein said side border surfaces are sloped inwardly toward the longitudinal axis of said elongated groove, (ii) said elongated guide comprises a top surface and spaced apart side surfaces, wherein said side surfaces are sloped inwardly toward the longitudinal axis of said elongated guide, and (iii) wherein said rigid plate member can slide in the traverse direction but cannot separate in the vertical direction from said elastomeric seal member.

4. The expansion joint system of claim 1, wherein said elongated guide is engaged with said elastomeric seal with at least one mechanical fastener.

5. The expansion joint system of claim 1, wherein said elongated guide is engaged with said elastomeric seal with an adhesive or bonding agent.

6. The expansion joint system of claim 1, wherein a portion of said elongated guide is molded into said elastomeric seal.

7. The expansion joint system of claim 1, wherein said rigid plate member comprises a metal plate, a metal alloy plate, or a composite material plate.

8. The expansion joint system of claim 7, wherein said rigid plate comprises a metal alloy plate selected from a rolled steel plate, a stainless steel plate, or a galvanized steel plate.

9. The expansion joint system of claim 7, wherein said rigid plate member comprises a metal plate member comprising an aluminum plate member.

10. The expansion joint system of claim 1, wherein said elastomeric seal member comprises styrene-butadiene rubber, butadiene rubber, butyl rubber, ethylene-propylene rubber, ethylene-propylene-diene rubber, polyisoprene rubber, polychloroprene rubber, ethylene-alkene copolymer rubbers, silicon rubber, nitrile rubber, and blends thereof.

11. The expansion joint system of claim 1, wherein said groove of said rigid bridging plate further comprises a low friction sliding surface layer.

12. The expansion joint system of claim 1, wherein said elongated guide comprises an elongated bar.

13. An expansion joint comprising:

spaced structural deck members with a gap located between said structural deck members;

an elastomeric seal member attached to one of the spaced structural deck members and capable of expanding and contracting in a longitudinal direction;

an elongated guide attached to said elastomeric seal member and having a longitudinal axis; and a rigid plate member having opposite facing top and bottom surfaces and a dimension sufficient to bridge said gap located between said spaced structural deck members, said rigid plate member having an elongated groove formed in said bottom surface, wherein said groove of said rigid plate member slidingly engages said elongated guide, wherein said rigid plate member and said elastomeric seal member are not fixedly attached together, and wherein said rigid plate member can move in a transverse direction along the elongated guide independently of the elastomeric seal member.

14. The expansion joint of claim 13, wherein said elastomeric seal member has a recess formed along at least a portion of a side of said seal member, and wherein said elongated guide is positioned within said recess of said elastomeric seal member and extends along at least a portion of said recess.

15. The expansion joint of claim 14, wherein (i) said elongated groove comprises a top border surface and spaced apart side border surfaces, wherein said side border surfaces are sloped inwardly toward the longitudinal axis of said elongated groove, (ii) said elongated guide comprises a top surface and spaced apart side surfaces, wherein said side surfaces are sloped inwardly toward the longitudinal axis of said elongated guide, and (iii) wherein said rigid plate member can slide in the traverse direction but cannot separate in the vertical direction from said elastomeric seal member.

16. The expansion joint of claim 14, wherein said rigid plate member comprises a metal plate, a metal alloy plate, or a composite material plate.

17. The expansion joint of claim 16, wherein said rigid plate comprises a metal alloy plate selected from a rolled steel plate, a stainless steel plate, or a galvanized steel plate.

18. The expansion joint of claim 16, wherein said rigid plate member comprises a metal plate member comprising an aluminum plate member.

19. The expansion joint of claim 13, wherein said elastomeric seal member comprises styrene-butadiene rubber, butadiene rubber, butyl rubber, ethylene-propylene rubber, ethylene-propylene-diene rubber, polyisoprene rubber, polychloroprene rubber, ethylene-alkene copolymer rubbers, silicon rubber, nitrile rubber, and blends thereof.

20. The expansion joint of claim 13, wherein said groove of said rigid bridging plate further comprises a low friction sliding surface layer.

21. The expansion joint of claim 13, wherein said elongated guide comprises an elongated bar.

22. An expansion joint system comprising:

an elastomeric seal member capable of expanding and contracting in a longitudinal direction;

an elongated guide having a longitudinal axis and attached to said elastomeric seal member;

a rigid plate member having opposite facing top and bottom surfaces and a dimension sufficient to bridge a gap located between spaced structural deck members;

wherein said elongated guide slidingly engages a groove in said rigid plate member;

wherein said rigid plate is not fixedly attached to the elastomeric seal member with any fastening means;

wherein said elastomeric seal member and said rigid plate member lie in the same horizontal plane; and wherein elastomeric seal member is capable of expanding and contracting in the longitudinal direction while the rigid plate member is capable of simultaneously moving independently in the transverse direction along the elongated guide.

* * * * *